US005433331A

United States Patent [19]

Morini

[11] Patent Number: 5,433,331

[45] Date of Patent: Jul. 18, 1995

[54] CAP FOR BOTTLES CONTAINING GASSED LIQUIDS

[75] Inventor: Emilio Morini, Colorno, Italy

[73] Assignee: Bormioli Metalplast, S.p.A., Parma, Italy

[21] Appl. No.: 253,673

[22] Filed: Jun. 3, 1994

[30] Foreign Application Priority Data

Jul. 26, 1993 [IT] Italy ..... M093A0095

[51] Int. Cl.[6] ..... B65D 53/00

[52] U.S. Cl. ..... 215/271; 215/252

[58] Field of Search ..... 215/231, 269, 270, 271, 215/277, 341, 252; 220/232, 240, 304, 378

[56] References Cited

U.S. PATENT DOCUMENTS 704,482 7/1902 Livingstone ..... 215/271 X
4,679,696 7/1987 Bonnenfant et al. ..... 215/252
4,747,497 5/1988 Holman ..... 215/230

FOREIGN PATENT DOCUMENTS 1138982 2/1957 France ..... 215/271

*Primary Examiner*—Allan N. Shoap
*Assistant Examiner*—Nova Stucker
*Attorney, Agent, or Firm*—Laff, Whitesel, Conte & Saret, Ltd.

[57] ABSTRACT

The cap assembly comprises: a cap which when unscrewed causes a detachment or distancing of a safety strip from the cap; and a convex seal which, when the cap assembly is inserted on a bottle, is deformed by internal pressure in the bottle and guarantees a seal on an internal wall of a bottle neck, even when there are small axial movements of the cap assembly with respect to the bottle neck.

6 Claims, 1 Drawing Sheet

Fig.1
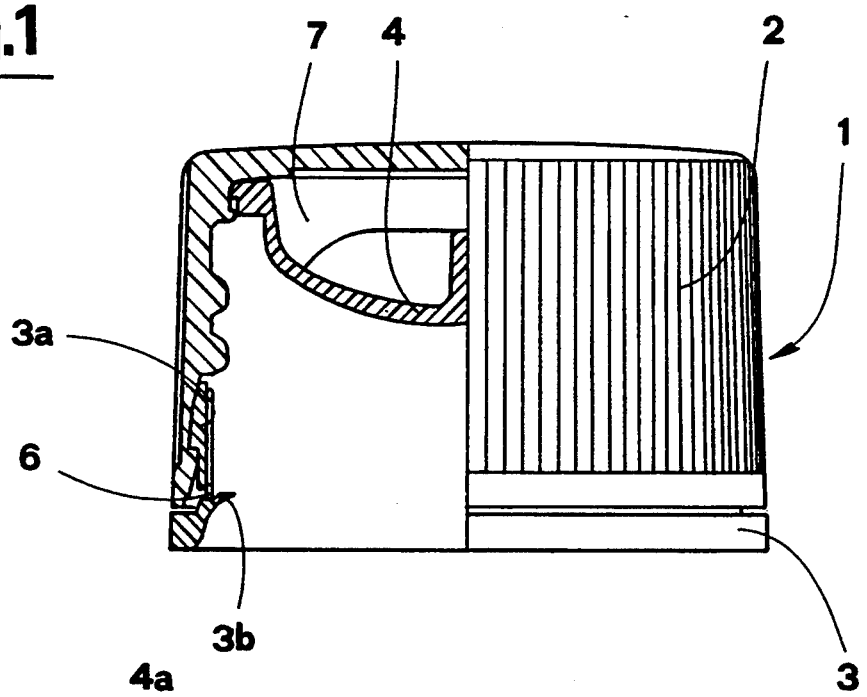
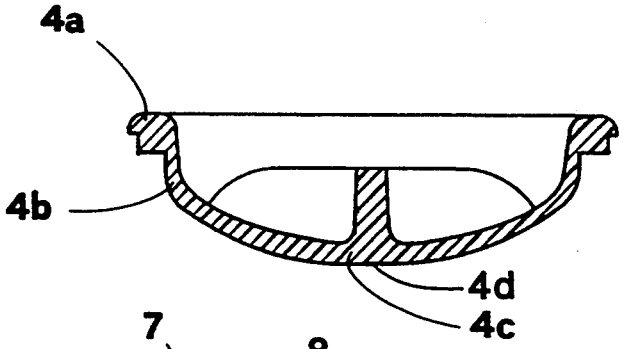
Fig.3
Fig.2
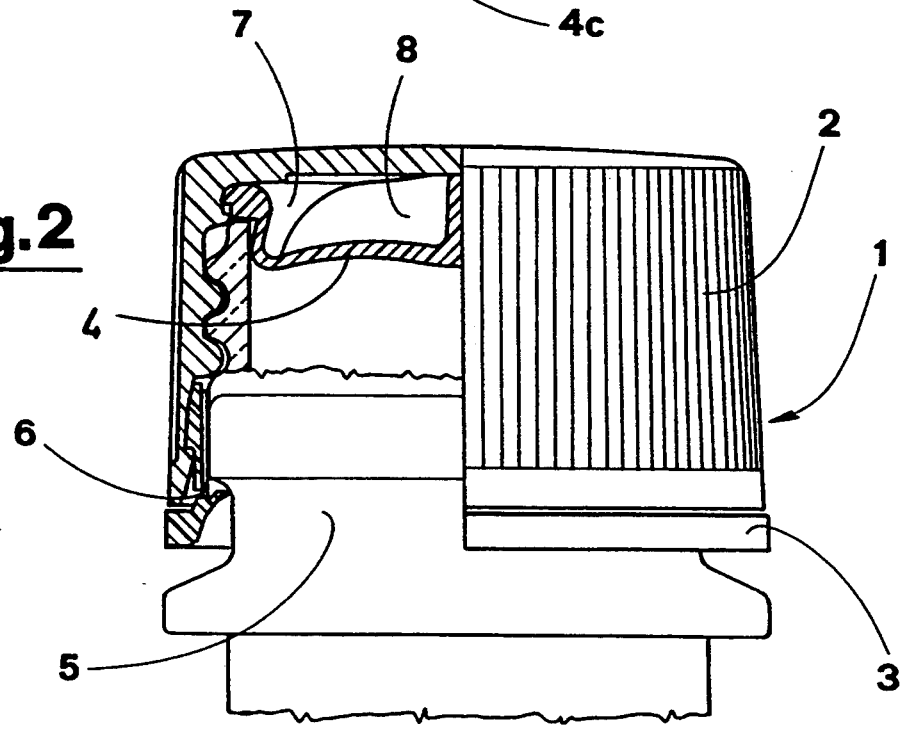

CAP FOR BOTTLES CONTAINING GASSED LIQUIDS

BACKGROUND OF THE INVENTION

In the following description, particular reference is made to caps made of plastic or other suitable material, wherein by unscrewing or lifting the cap a safety strip is detached or at least distanced.

Caps of the above type not only present drawbacks connected to construction simplicity and fast screwing-on by automatic machines, but also pose a significant problem, common to all caps comprising safety strips, of safeguarding a consumer against illicit opening of the bottle.

Several known caps offer quite satisfactory solutions to this problem, but it has been noted that often it is possible to unscrew a cap very slightly, not enough to break the safety strip (and thus prove that the bottle has indeed been opened) but, on the other hand, quite enough to break the original seal and allow gas, and even liquid, to escape from inside. What is more, and more serious, it would be possible to introduce fluids into the bottle in this way, and all without its being obvious thereafter to a consumer. Especially with plastic bottles, this risk is high, since pressing on the lateral wall of the bottle causes it to function like a suction pump; but the risk also exists with glass or other rigid bottles, which could be totally immersed in a bath of liquid to cause invasion of extraneous fluid.

A principal aim of the present invention is to obviate the above-mentioned drawbacks, by providing a cap which allows no gas to escape from the bottle, nor any introduction of extraneous fluid therein, unless the safety strip has already been removed.

One advantage of the invention is that no extra cost is incurred by its use, nor is cap use consequently complicated.

SUMMARY of the INVENTION

The above aims and advantages, and others besides are all attained by the invention, which like known cap assemblies comprises a cap which, when unscrewed, causes a safety strip to break or be distanced from the cap itself, and which exhibits an upper convex seal which, when the assembly is inserted on the bottle, is deformed by internal pressure in the bottle and guarantees a seal against an internal wall of a bottle neck, a seal which is guaranteed even when the assembly is slightly moved in an axial direction.

BRIEF DESCRIPTION OF THE DRAWINGS

Further characteristics and advantages of the present invention will better emerge from the detailed description that follows, of a preferred but non-exclusive embodiment here illustrated in the form of a non-limiting example in the accompanying drawings, in which:

FIG. 1 is a partly-sectioned vertical elevation of the cap assembly of the invention;

FIG. 2 is a partly-sectioned vertical elevation of the cap assembly inserted on a neck of a bottle;

FIG. 3 is a vertical elevation of the seal of the cap assembly.

DESCRIPTION OF THE PREFERRED EMBODIMENTS

The figures and the following description make reference to a particular type of cap assembly, but the concept disclosed and described hereinbelow should be taken as applicable to any type of capsule made in plastic or other materials such as aluminium, for bottles containing gassed liquids where a detachment or distancing of the cap from the bottle neck is achieved by screwing or lifting, and comprises and causes a breaking or distancing of the safety strip from the cap.

The cap assembly 1 is made in plastic in three separate pieces, which are assembled before insertion of the assembly 1 on a neck 5 of a bottle.

The cap assembly 1 comprises a first piece constituted by a cap 2 which is screwed on a bottle neck and which is reused subsequently to close the bottle.

The second part of the cap assembly 1 is an annular element comprising a first ring 3*a* which joints into the lower part of the cap assembly 1, and a safety strip 3 connected to the first ring 3*a* by easy-break struts 6, which ring 3*a* is provided with a protruberance 3*b* that, when the cap assembly 1 is inserted on the bottle, locks under an underlip on the bottle neck. When the cap is first unscrewed, the cap 2 is lifted and draws the first ring 3*a* and the safety strip 3, but when the protruberance 3*b* comes into contact with the underlip of the bottle neck, the cap 2 and first ring 3*a* upwards translation causes the struts 6 to break: thus evidence is provided that the bottle has indeed been opened.

The aforegoing is intended as an example of a known-type cap assembly 1, and should not be understood as providing a limit to the application of the following inventive concept.

The cap assembly 1 comprises a convex seal 4 connected to an upper part of the cap 2 and made in a deformable material, which is then deformed by gas pressure coming from inside the bottle. The seal 4, together with the upper internal wall of the cap 2, define a sack 7 facing inwardly of the bottle.

The convex seal 4 comprises a first annular zone 4*a* which fits snugly into a likewise annular recess in the upper internal part of the cap 2, to ensure a good connection between the seal and the cap. The cap recess section, however, will be slightly larger than the annular zone 4*a* section, to allow the convex seal 4 to rotate freely with respect to the cap 2.

The seal 4 further comprises a second zone 4*b*, which is slightly truncoconical and which larger base coincides with the circumference of the first zone 4*a* and which minimum diameter is slightly smaller than the internal diameter of the bottle neck. The maximum diameter of the first zone 4*a* can be either smaller or slightly bigger than the internal diameter of the bottle neck. The height of the second zone 4*b* is greater than the minimum length of the axial movement of the cap 2 which would cause the struts 6 to break a third dome-shaped zone as shown in FIG. 3, 4*c* is connected to the lower base of the second zone 4*b*. The dome-shaped zone 4*c* has a central flat outer surface, 4*d*. The length along the outer surface of the dome-shaped zone, as measured along its intersection with a cross-sectional plane running through the center of zone 4*c*, is greater than the length of the internal diameter of the bottle neck.

The third zone 4*c* exhibits a striker element comprising a cross-rib 8, coaxial to the third zone 4*c* and which arms are shorter than the diameter of the lower base of the second zone 4*b*. The cross-rib 8 height is about the same as the difference between the maximum height of the chamber 7 and the maximum camber of the third zone 4c of the seal. Obviously the striker element could be made instead on the lower internal wall of the cap 2.

When the cap 2 is not inserted on the bottle, the convex seal 4 is shaped as can be seen in FIG. 1. Depending on whether the maximum diameter of the first zone 4a is less or greater than the internal bottle neck diameter, the seal will insert either freely or with slight interference; but in any case this operation will present no problems to the machine performing the task. When the cap assembly 1 has been inserted on the bottle neck, the pressure generated by the gassy liquid inside he bottle will cause the convex seal 4 to assume a second, deformed shape, illustrated in FIG. 2, where the seal 4, thanks to its conformation and dimensions, is forced against the internal wall of the bottle neck and achieves a perfect seal.

Worthy of note is the fact that the cap assembly 1 is inserted on the bottle neck up to where the upper part of the beck strikes against the annular zone 4a of the seal 4: the seal zone on the internal part of the neck is in a position that, given the height of the seal zone 4b, is displaced downwardly internally of the bottle neck by a length which is greater than the minimum length of the axial displacement of the cap 2, causing the struts 6 to fracture.

In the deformed position, the convex seal 4, thanks to the presence of the cross-ribs 8 striking against the upper internal wall of the cap 2, stretches, and reaches a maximum extension, obtaining a seal effect on the lateral wall of the bottle neck.

By slightly unscrewing the cap 2, the annular element connected to it is freely lifted up until the projection 3b contacts with the underlip on the bottle neck. During this operation, the seal zone between the seal 4 and the internal part of the bottle neck lifts upwards, while maintaining its sealing function, and only when the cap is lifted far enough to cause the struts 6 to break does the seal zone exit from the bottle neck and cease its function.

With known cap assemblies by lifting the cap 2 only slightly the seal between assembly and bottle is compromised, while with the present invention a perfect seal is preserved. In other words, exit of fluid from the bottle, or introduction of extraneous fluid into the bottle, are impossible without first breaking the struts 6.

Also worthy of note is the fact that the cap does not have to be forced open, as is the case with several known caps, since it can rotate freely with respect to the seal 4.

Finally, after a first opening, reutilization of the cap restores a perfect seal, even though the internal pressure in the bottle has by this time considerably diminished, or even totally removed, since it is the seal zone 4a that by leaning on the upper part of the bottle neck guarantees the seal, as in other known caps.

What is claimed is:

1. A cap assembly for bottles containing gassed liquids, comprising:

a cap, to be attached to a neck of a bottle;

a safety strip detachably connected to the cap;

a plurality of easy-break struts connecting the safety strip to the cap and fracturable when the cap is unscrewed or raised in an axial direction with respect to the bottle;

a convex seal made of a deformable material and connected to an internal upper part of the cap;

a chamber being formed between an internal side of the convex seal and said internal upper part of the cap, wherein the convex seal is deformed by pressure within the bottle when said cap is inserted on the bottle neck and is forced against an internal wall of the bottle neck; the convex seal has an annular zone which connects with an annular recess formed in said internal upper part of the cap;

a trunconical zone having a larger base which coincides with an internal circumference of the annular zone and which minimum diameter is slightly smaller than an internal diameter of the bottle neck and which height is greater than a minimum displacement distance of the cap in order to break the safety strip;

a dome-shaped zone connected to a lower base of the trunconical zone having a length measured along a cross-sectional plane running through a center of said dome-shaped zone greater than a length measured along an internal diameter of said bottle neck;

a striker element on a concave internal wall of said dome-shaped zone, which, following a deformation of the convex seal, interferes with the cap and limits deformation of the convex seal.

2. A cap assembly as in claim 1, wherein the striker element exhibits a cross-rib fashioned on the convex seal coaxially to the dome-shaped zone, said cross-rib having arms which are shorter than a diameter of the lower base of the truncoconical zone and being of an equal height to a difference between a maximum height of the chamber and a maximum camber of the dome-shaped zone of the convex seal.

3. A cap assembly as in claim 1, wherein a connection between the annular zone and the annular recess made in the upper internal part of the cap is conformed such as to allow the convex seal to rotate freely in relation to the cap.

4. The cap assembly of claim 1 wherein said third zone has a central flat outer surface portion.

5. The cap assembly of claim 2 wherein said third zone has a central flat outer surface portion.

6. The cap assembly of claim 3 wherein said third zone has a central flat outer surface portion.

* * * * *

UNITED STATES PATENT AND TRADEMARK OFFICE

CERTIFICATE OF CORRECTION

PATENT NO. : 5,433,331

DATED : July 18, 1995

INVENTOR(S) : Emilio Morini

It is certified that error appears in the above-indentified patent and that said Letters Patent is hereby corrected as shown below:

Column 4, line 8, delete "unscrewed or"

Signed and Sealed this

Tenth Day of October, 1995

*Attest:*

Bruce Lehman

BRUCE LEHMAN

*Attesting Officer*

*Commissioner of Patents and Trademarks*